United States Patent [19]

Mohnhaupt

[11] 4,249,161

[45] Feb. 3, 1981

[54] LOCK FOR THE DOORS OF AUTOMOBILES

[75] Inventor: Dietrich F. A. Mohnhaupt, Bassins, Switzerland

[73] Assignee: Saseb Aktiengesellschaft, Eschen, Liechtenstein

[21] Appl. No.: 25,945

[22] Filed: Apr. 2, 1979

[30] Foreign Application Priority Data

Apr. 13, 1978 [CH] Switzerland ..... 3944/78

[51] Int. Cl.[3] ..... G08B 21/00

[52] U.S. Cl. ..... 340/52 D; 70/239; 70/432; 200/61.64; 200/61.67; 340/547; 340/687

[58] Field of Search ..... 340/52 D, 522, 540, 340/542, 547, 549, 687; 200/61.64, 61.67, 61.68, 61.76, 61.81; 70/239, 251, 432, 434, DIG. 30, DIG. 49, DIG. 59

[56] References Cited

U.S. PATENT DOCUMENTS

| | | | |
|---|---|---|---|
| 2,186,546 | 1/1940 | Lakin | 340/542 X |
| 2,339,170 | 1/1944 | Jacobs | 340/52 D |
| 2,638,516 | 5/1953 | Forman | 200/61.67 |
| 3,259,708 | 7/1966 | Sandor | 200/61.64 X |
| 3,697,943 | 10/1972 | Andres | 340/52 D |
| 3,757,064 | 9/1973 | Ogawa | 200/61.64 |
| 3,803,575 | 4/1974 | Gotande | 340/542 X |
| 3,828,340 | 8/1974 | Bauer, Jr. et al. | 340/542 |
| 4,127,856 | 11/1978 | Bickel | 340/687 |

*Primary Examiner*—John W. Caldwell, Sr.
*Assistant Examiner*—Joseph E. Nowicki
*Attorney, Agent, or Firm*—Ostrolenk, Faber, Gerb & Soffen

[57] ABSTRACT

A lock for the door of an automobile which is provided with an electrical signalling circuit for indicating to the driver whether the lock is opened, partially closed, or fully closed. The lock has a main supporting body. A movable member is held on the body and assumes a first position when the lock is closed, a second position when the lock is partially closed and a third position when the lock is open. The lock also includes a magnet switch which is connected in the electrical signalling circuit. A projection is connected with the movable member such that when the movable member is in the first position at which the lock is fully closed, the projection is interposed between the reed relay and the permanent magnet and this interrupts the magnetic flux lines between the magnet and the reed relay contacts, causing the contacts to open and opening the electrical signalling circuit. The movable member and projection thereon are so placed that when the movable member in the second or third positions at which the door lock is respectively either partially closed or fully open, the projection is not positioned to interrupt the magnet flux lines and the switch contacts remain closed, energizing the electrical signalling circuit.

7 Claims, 6 Drawing Figures

LOCK FOR THE DOORS OF AUTOMOBILES

BACKGROUND OF THE INVENTION

The present invention relates generally to locks for the doors of a vehicle. In particular, it is related to locks for, cars, which locks are provided with an electrical signalling circuit for indicating to the driver whether the door of the car is open, only partially closed, or correctly fully closed. Still more in particular, the invention relates to a lock as defined above and comprising a supporting body, a movable member which is held by said body and is able to occupy a first position wherein the lock is closed, a second position wherein the lock is partially closed, and a third position wherein the lock is open.

Electrical warning systems, e.g. for cars, have in principle already been proposed. Thus, U.S. Pat. No. 3,771,154 (Takei) discloses a warning system and apparatus including a device for receiving a signal indicative of an abnormal condition. A magnetic switch cn be used for sensing the existence of abnormal conditions. The warning system circuit is enabled when a magnet is moved away from the magnetic switch, i.e. when a door is opened to which the magnet is attached. The use of the system in a car is disclosed to be possible but is not described.

U.S. Pat. No. 3,697,943 proposes an installation for indicating the closed condition of vehicle doors based upon the status of a vacuum source.

In U.S. Pat. Nos. 3,426,166 and 3,539,741(Voland), magnetically operated or activated door switches, but not closure indicating devices, are described.

The location of overhead doors can be detected, according U.S. Pat. No. 3,975,723 (Bowling et al.) by reed switches which are under the influence of a (feeble) permanent magnetic field and a stronger, movable field.

None of these patents discloses or suggests the invention which is to be described now in detail.

SUMMARY OF THE INVENTION

The main object of the invention is to provide a lock for vehicles, especially motor car vehicles, which is fitted with means for indicating at distance and in the normal field of view of the driver, whether the lock of a particular door of his car is correctly closed, partially open or fully open.

Another object of this invention is to provide a lock wherein the device creating such indicating signals is reliable, simple and not expensive.

Still a further object of the invention is to provide a lock of the above defined kind wherein the signalling means cannot be damaged from the exterior of the door and do not suffer from corrosion in the often damp interior of the vehicle door.

These and other objects of the invention are fulfilled by the lock of the invention which comprises a supporting body and a movable member which is held by the body and is able to assume a first position when the lock is closed, a second position when the lock is partially closed and a third position when the lock is open. The lock is further provided with a magnetic switch, contained in said electrical signalling circuit. Means which are controlled by said movable member and serve to cause this switch to close when the movable member is in the second and third position.

The magnetic switch is generally constituted by a reed relay, held by the supporting body and connected to the electrical signalling circuit, and by a permanent magnet carried by the supporting body near said reed relay so as to cause the contacts contained in this relay to be closed. The movable member is provided with a projection which is interposed between the reed relay and the permanent magnet when the movable member is in said first position so as to interrupt the magnetic flux lines between the magnet and the contacts of the relay so as to cause said contacts to open.

Use of a reed relay in a lock in accordance with the invention enables a number of advantages to be obtained. The contacts within the reed relay are protected against the moisture often present in the interior of the door of automobiles. A micro-switch, whatever its type, will frequently break down because of this dampness.

Because of the protection provided by the reed relay, the laminations contained therein cannot oxidize and cannot fuse in the zone of contact.

The reed relay can therefore be used advantageously in a lock according to the invention because of its remarkable reliability in operation, which enables it to function as required, without risk of breakdown, during a very large number of working cycles.

Furthermore, the reed switch offers advantages as regards the precision with which it functions.

A further advantage provided by such a switch is that it is of very small dimensions so that it can be readily fitted in the lock of an automobile door.

Other objects and advantages of the invention will emerge from the following description relating to the attached drawings showing, by way of a non-limiting example, one form of construction and a variant thereof.

DESCRIPTION OF THE PREFERRED EMBODIMENT

Figure 1:
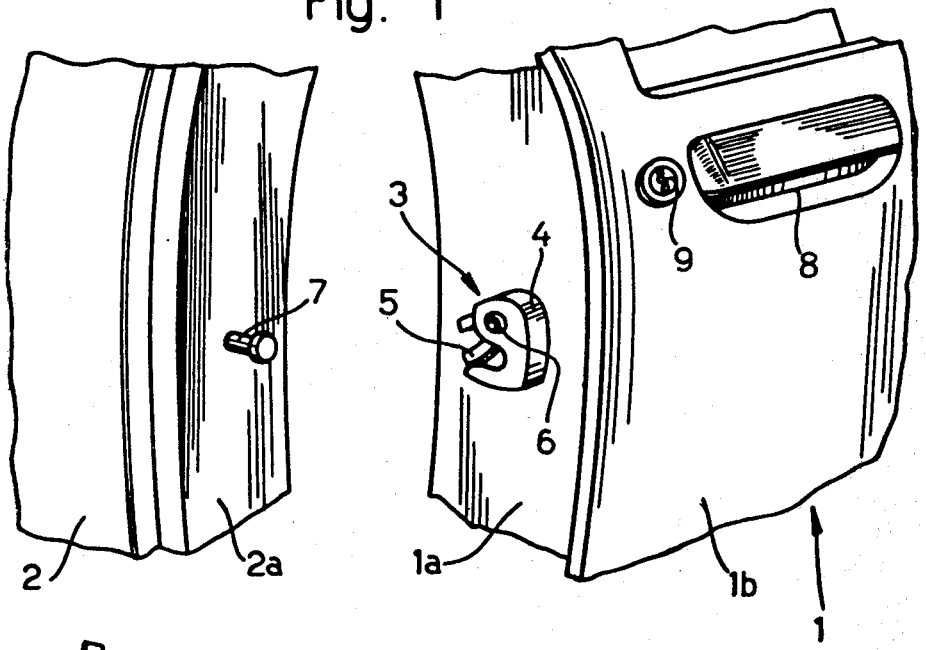
FIG. 1 is a perspective view of a lock of a known type intended for use in the door of an automobile.

The automobile door illustrated in FIG. 1 and designated by the reference numeral 1 has an edge 1*a* and an outer surface 1*b*. The reference numeral 2 designates a portion of the bodywork of the vehicle comprising an edge 2*a*. The edge 1*a* of the door 1 is adapted to occupy a position wherein it is opposite the edge 2*a* of the bodywork 2 when the door 1 is in the closed position.

Secured to the edge 1*a* of the door is a lock 3 comprising a supporting body 4 and an engagement member constituted by a bifurcated element 5 which is able to turn about a pivot 6 carried by the supporting body 4.

This engagement member 5 is known as a "stop member" by specialists in this field.

This engagement member 5 is adapted to cooperate in known manner with an abutment member 7 carried by the bodywork 2 opposite the edge 2*a* when the door 1 is in the closed position.

The lock, as illustrated in FIG. 1, is of the type wherein the engagement member 5 occupies a first position which corresponds to closing of the lock, a second position which corresponds to partial closing of the lock, and a third position which corresponds to the opening of the lock. The reference numeral 8 designates a handle for controlling the opening of the lock 3, this handle being fitted on the outer surface 1*b* of the door 1. The reference numeral 9 designates a rotating cylinder which can be actuated with the aid of a key so as to bring the lock 3 to the blocked position from the outside of the automobile.

Figure 2:
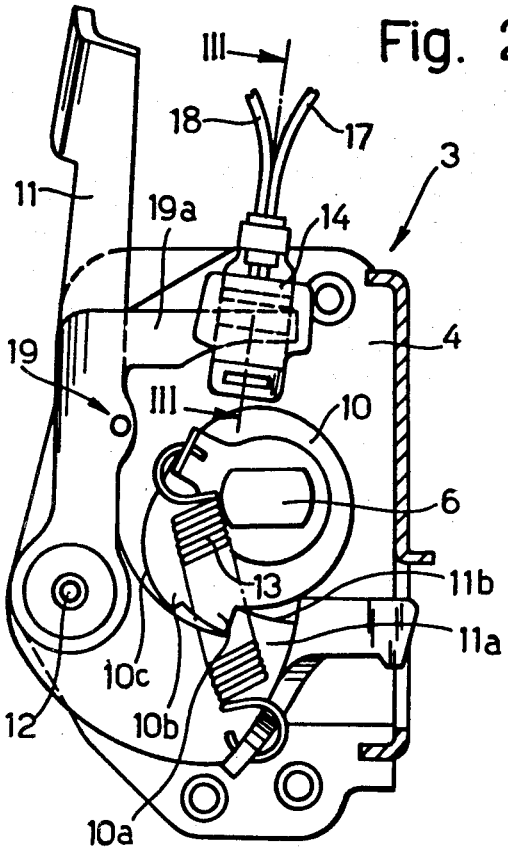
FIG. 2 is an elevational view of a lock in accordance with the invention.
Figure 3:
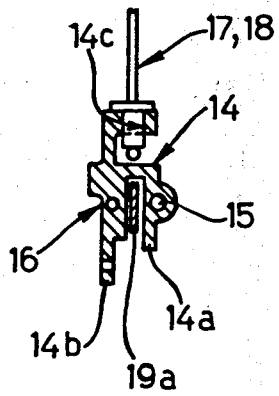
FIG. 3 is a sectional view of a detail from FIG. 2 on line III—III of that FIGURE.

FIG. 2 illustrates that portion of the lock which faces the interior of the edge 1*a* of the door of the vehicle.

The part common to the lock of the invention and the lock of known type illustrated in FIG. 1 are designated by the same reference numerals.

The reference numeral 10 designates a rotating member of known type articulated on the pivot 6 of the bifurcated element 5 (not shown) and solidly connected to and rotatable with the latter.

The reference numeral 11 designates a lever of a type known per se, articulated on the supporting body 4 of the lock on the point. The lever is adapted to be connected in known manner, by a mechanical transmission means, to the handle 8 of the vehicle door 1.

Fitted between the element 10 and the lower arm of the lever 11 is a spring 13 which urges the element 10 and the engagement member 5 into a position corresponding to the open position of the lock.

The lever 11 extends to the right of pivot 12 in FIG. 2 to a tooth 11*a* adapted to cooperate, in known manner, with two annularly spaced apart teeth 10*a* and 10*b* provided on the element 10 so as to define the two other positions of the engagement member 5.

The element 10 and the lever 11 thus each have a first position which corresponds to the closed position of the lock, a second position which corresponds to the partially closed (or partially opened) position of the lock, and a third position which corresponds to the open position of the lock.

When the tooth 11*a* of the lever 11 engages the tooth 10*a* of the element 10, the engagement member 5 is in its first position corresponding to the closed position of the lock. This is the position illustrated in FIG. 2.

Upon pivoting of lever 11 clockwise about pivot 12, due to operation of handle 8, tooth 11*a* is moved down and spring 13 is charged. Element 10, now freed of tooth 11*a*, is biased to rotate counterclockwise until tooth 10*b* is caught by tooth 11*a* of lever 11. The lever has been returned for such engagement by spring 13.

When the tooth 11*a* of the lever 11 is applied to the tooth 10*b* of the element 10, the engagement member 5 occupies its second position, which corresponds to the partially closed position of the lock.

Upon new displacement clockwise of lever 11, tooth 10*b* is disengaged from tooth 11*a*. Element 10 continues to rotate counterclockwise under the bias of spring 13 until the tooth 11*a* contacts surface 10*c*.

When the element 10 is turned in the anti-clockwise direction relatively to the position illustrated in FIG. 2 so that the tooth 11*a* is in contact, by one of its faces 11*b*, with an edge 10*c* of the element 10, the engagement member 5 then occupies a position which corresponds to the open position of the lock. Reclosing the door reengages pin 7 and engagement member 5 and rotates member 5 to the closed position of the lock.

The lock in accordance with the invention is provided with a supporting member 14 of plastics material mounted on the supporting body 4 of the lock 3. The member 14 has a U-shaped portion, one of the limbs of which is designated by the reference numeral 14*a* and the other by the reference numeral 14*b*.

The limb 14*a* contains a permanent magnet 15 of cylindrical shape. Fitted in the limb 14*a* is a reed relay 16 of known type. This relay need not to be described in detail since it is of classic construction, known to the one skilled in the art.

The supporting member 14 comprises a portion 14*c* in which are formed two holes for guiding two electric cables 17 and 18 connected to the terminals of the relay 16. The reed relay 16 is fitted in an electrical signalling circuit which serves to indicate to the driver of the automobile, by accoustic or optical means, whether the door of the automobile is open or partially closed. The magnetic flux lines set up by the permanent magnet 15 perform the function of closing the contacts 16 fitted in the reed relay. The signalling circuit need also not to be described in detail. Any appropriate circuit may be used which comprises, in its simplest form, a signal generator, e.g. an a.c. or d.c. current source, said relay, and for each lock, a loudspeaker or an electric lighting means like bulbs or LEDs.

Secured on the lever 11 is a small plate 19 of angled form, the free arm 19*a* of which extends perpendicularly to the lever 11.

The supporting member 14 of the permanent magnet 15 and the reed relay 16 as well as the small plate 19 are so arranged that the lever 11 occupies a position corresponding to the closed position of the lock (that is to say when the tooth 11*a* is applied to the tooth 10*a* of the element 10 as illustrated in FIG. 2, the free arm 19*a* is interposed between the magnet 15 and the relay 16, thus interrupting the magnetic flux lines mentioned above and causing the contacts contained in the relay to open.

On the other hand, when the lever 11 does not occupy a position corresponding to the closed position of the lock but is in some other position that is angularly offset in the clockwise direction relatively to the position illustrated in FIG. 2, the arm 19*a* no longer interrupts the magnetic flux lines between the magnet 15 and the relay 16, the contacts situated within the relay 16 close, and the driver of the vehicle receives the required signal.

In the lock as illustrated or in a lock of a different design, the movable member to which the small plate 19 is secured could, of course, be a member other than the lever 11. Thus for example, in the lock illustrated, the movable member could be rotatable member 10.

In fact it suffices if the movable member, to which is secured the small plate 10, is able to occupy a first position when the lock is closed, a second position when the lock is partially closed, and a third position when this lock is open.

It would of course be possible to use the same movable member as a screen for intercepting the magnetic flux lines between the magnet and the reed relay.

Figure 4:
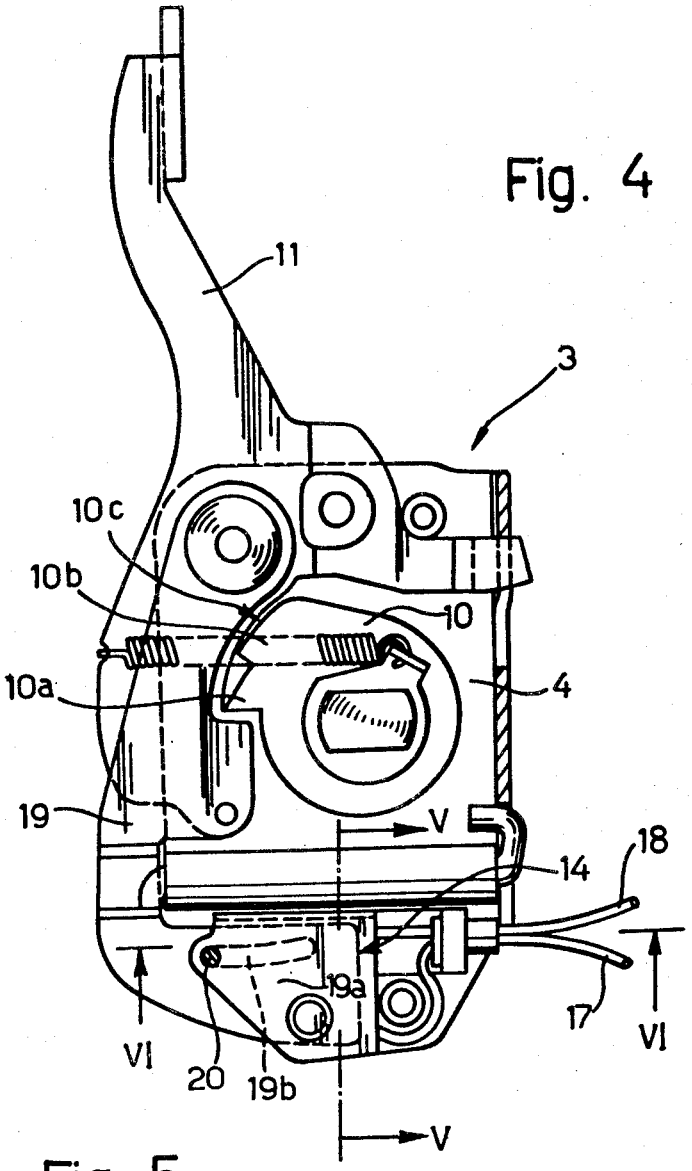
FIG. 4 shows a variant of the FIG. 2 arrangement.
Figure 5:
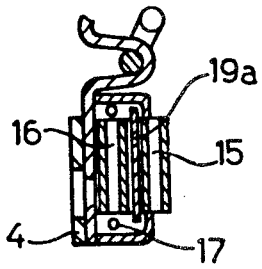
FIG. 5 is a section on Line V—V of FIG. 4 and shows a detail from the latter.
Figure 6:
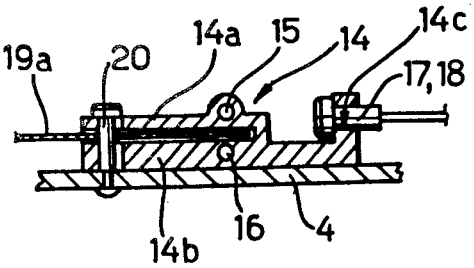
FIG. 6 is a section on line VI—VI of FIG. 4.

The variant illustrated in FIGS. 4, 5 and 6 is characterized by a different arrangement of the small plate 19 on the lever 11 and by a different position of the supporting member 14.

Furthermore, a pivot 20 is secured to the supporting body 4 of the lock 3 and the supporting member 14, which pivot slides along a small slot 19*b* which is formed in the plate 19, so that it serves as a guide element for the displacement of this small plate 19.

It will be obvious to those skilled in the art that various and numerous modifications of the present invention may be resorted to without departing from the spirit of the invention the scope of which is determined by the attached claims.

What I claim is:

1. A lock for the door of an automobile, the lock being provided with an electrical signalling circuit for indicating to the driver whether the lock for the door of the automobile is open or partially closed, said lock comprising a supporting body and a movable member which is held by said body and is able to assume a first position when the lock is closed, a second position when the lock is partially closed, and a third position when the lock is open, the lock being further provided with a magnetic switch, contained in said electrical signalling circuit, said magnetic switch including a reed relay, which is held by said supporting body and is connected to said electrical signalling circuit, said switch also including a permanent magnet carried by said supporting body near said reed relay and said magnet having the characteristic of causing the contacts contained in said relay to be closed, said movable member being provided with a projection which is interposed between said reed relay and said permanent magnet when said movable member is in said first position so as to interrupt the magnetic flux lines between said magnet and the contacts of the relay so as to cause said contacts to open, and means controlling said movable member to cause said switch contacts to close when said movable member is in said second and third position.

2. The lock according to claim 1 wherein said movable member is constituted by a lever which is pivoted on the supporting body of said lock and is adapted to be connected, through a mechanical transmission means, to a handle for opening the lock from within the automobile, said projection being constituted by a small plate disposed perpendicularly to said lever.

3. The lock according to claim 2 wherein said small plate is a right-angled element having two arms, one arm of said element is secured on said lever and the other arm of said element is disposed perpendicularly to said lever in a plane perpendicular to the axis about which said lever pivots.

4. The lock according to claim 3 wherein said other arm of said small plate that extends perpendicularly to said lever is provided with a slot, said supporting body of the lock being provided with a pivot which is adapted to slide in this slot to guide the movement of this plate.

5. The lock according to claim 1 further comprising a supporting member made of plastics material secured to said supporting body of the lock, said reed relay and the corresponding said permanent magnet being carried by said supporting member.

6. The lock according to claim 5 wherein said supporting member comprises an U-shaped portion having two arms, in one arm of the U is lodged said relay and in the other arm of the U is lodged the corresponding said permanent magnet, and said projection is housed in the cavity of said U-shaped portion when said movable member occupies said first position.

7. The lock according to claim 1 wherein said projection is so placed on said movable member that said projection is not interposed between said reed relay and said magnet when said movable member is in said second and said third positions.

* * * * *